US005143596A

United States Patent [19]

Maxwell et al.

[11] Patent Number: 5,143,596

[45] Date of Patent: Sep. 1, 1992

[54] PROCESS FOR UPGRADING A SULPHUR-CONTAINING FEEDSTOCK

[75] Inventors: Ian E. Maxwell; Frederik Muller, both of Amsterdam; Frank H. H. Khouw, The Hague; Kim H. Khor, The Hague; Jacques Lucien, The Hague, all of Netherlands

[73] Assignee: Shell Oil Company, Houston, Tex.

[21] Appl. No.: 617,844

[22] Filed: Nov. 23, 1990

[30] Foreign Application Priority Data

Nov. 24, 1989 [GB] United Kingdom ..... 8926555

[51] Int. Cl.[5] ..... C10G 45/00; C10G 63/02; C10G 69/08; C10G 35/06

[52] U.S. Cl. ..... 208/89; 208/62; 208/66; 208/97; 208/135; 208/136; 208/137

[58] Field of Search ..... 208/62, 66, 97, 99, 208/211, 216, 89, 133, 134–136, 142–145

[56] References Cited

U.S. PATENT DOCUMENTS

| | | | |
|---|---|---|---|
| 4,190,519 | 2/1980 | Miller et al. | 208/62 |
| 4,362,613 | 12/1982 | MacLean | 208/102 |
| 4,457,832 | 7/1984 | Robinson | 208/66 |
| 4,627,909 | 12/1986 | Robinson | 208/65 |
| 4,655,905 | 4/1987 | Plumail et al. | 208/216 R |
| 4,867,864 | 9/1989 | Dessau | 208/138 |
| 4,960,505 | 10/1990 | Minderhoud et al. | 208/89 |
| 5,013,423 | 5/1991 | Chen et al. | 208/64 |

FOREIGN PATENT DOCUMENTS

| | | |
|---|---|---|
| 131975 | 1/1985 | European Pat. Off. . |
| 271264 | 6/1988 | European Pat. Off. . |
| 332243 | 9/1989 | European Pat. Off. . |
| 8602629 | 5/1986 | PCT Int'l Appl. . |

OTHER PUBLICATIONS

*The Petroleum Handbook,* Third Edition, The Shell Petroleum Company, Ltd., 1948, pp. 226–227.

N. Y. Chen and T. R. Degnan, "Industrial Catalytic Applications of Zeolites," Chemical Engineering Progress (Feb. 1988).

*Primary Examiner*—John Niebling
*Assistant Examiner*—P. L. Hailey

[57] ABSTRACT

Process for upgrading a sulphur-containing feedstock consisting of a hydrocarbon mixture substantially boiling in the gasoline range which process consists of subjecting the feedstock to a reforming step and subsequently to a hydrotreating step, and recovering from the hydrotreating step a product substantially boiling in the gasoline range and having increased aromaticity and decreased sulphur content.

20 Claims, No Drawings

PROCESS FOR UPGRADING A SULPHUR-CONTAINING FEEDSTOCK

FIELD OF THE INVENTION

The present invention relates to a process for upgrading a sulphur-containing feedstock and is particularly concerned with improving the quality of a feedstock which comprises hydrocarbons boiling in the gasoline range obtained by catalytic cracking.

BACKGROUND OF THE INVENTION

Gasoline obtained by catalytic cracking requires further processing before it can satisfactorily meet the present day stringent requirements for high octane and low sulphur content. Thus catalytically cracked gasoline has a comparatively high olefin content, a low aromatics content and if there has been no initial treatment of the feedstock, an unacceptable high sulfur content. Quality improvement may be carried out by catalytic reforming with, for instance platinum-containing reforming catalysts. However, the presence of sulphur- and nitrogen-containing compounds in the reformer feedstock reduces the performance of such catalysts and removal of these compounds by catalytic hydrotreatment is thus considered necessary prior to reforming in order to ensure sufficient catalyst life time, with consequent increase in cost.

SUMMARY OF THE INVENTION

Surprisingly, it has been found that a feedstock containing an unacceptable high portion of sulphur and substantially boiling in the gasoline range, can very attractively be upgraded in respect of aromatics and sulphur content in a two-stage process wherein the sulphur-containing feedstock is firstly subjected to a specific reforming step and subsequent to a hydrotreating step.

Accordingly, the present invention relates to a process for upgrading a sulphur-containing feedstock comprising a hydrocarbon mixture substantially boiling in the gasoline range which process comprises subjecting the feedstock to a reforming step and subsequently to a hydrotreating step, and recovering therefrom a product substantially boiling in the gasoline range and having increased aromaticity and decreased sulphur content.

It has further been found that in the present process, the hydrotreatment can be carried out at far milder conditions than is customary whilst still obtaining a product of good quality substantially boiling in the gasoline range. Consequently, the present invention constitutes an attractive novel (less complicated) process which can overall suitably be carried out under milder conditions. Moreover, in the process according to the present invention a high yield of liquid products can be obtained, whilst the hydrotreating step is moreover advantageously controlled and controllable.

DESCRIPTION OF THE INVENTION

Preferably use is made of hydrocarbon mixture substantially boiling in the gasoline range which can be obtained by catalytic cracking although it may be obtained by other cracking process such as thermal cracking, delayed coking, visbreaking and flexicoking. Such gasoline feedstocks usually contain unacceptable levels of sulphur, usually more than 50 ppmw, oftern above 100 ppmw or even more than 500 ppmw.

Other suitable feedstocks to be processed in accordance with the present invention comprise substantially naphthenes-containing hydrocarbon mixtures, for instance straight run naphthas, or mixtures of hydrocarbonaceous materials which may be derived from a cracking process and substantially naphthenes-containing hydrocarbonaceous materials.

The feedstock to be processed is suitably obtained by the application of catalytic cracking, usually fluid catalytic cracking of heavy hydrocarbon oils, such as vacuum gas oils, flashed distillates, long residues, deasphalted vacuum residues and mixtures thereof. Fluid catalytic cracking on a commercial scale is usually carried out in a continuous process using an arrangement which consists substantially of a vertically arranged cracking reactor and a catalyst regenerator. The oil to be cracked is brought in contact with hot regenerated catalyst coming from the regenerator. The mixture of oil and catalyst is passed through the reactor section in an upward direction. In the reactor section coke is deposited on the catalyst as a result of which the catalyst is deactivated. The deactivated catalyst is separated from the product and, after stripping, transported to the regenerator. The cracked product is separated into a light fraction having a high content of $C_3$ to $C_4$ olefins, a gasoline fraction and several heavy fractions, such as a light cycle oil, a heavy cycle oil and a slurry oil.

The sulphur-containing feedstock may consist entirely of a fraction substantially boiling in the gasoline range, i.e. substantially boiling in the range $C_4$–220° C. However, other light components, capable of benefitting from aromatization, may be included in the feedstock and coprocessed therewith in the reforming step, for example a mixture substantially comprising normally gaseous olefins and/or paraffins such as $C_{2-4}$ olefins and/or $C_7$ paraffins. While the full gasoline boiling range fraction from the cracking reactor may be included in the feedstock, it may be preferred to employ as hydrocarbon mixture a cut thereof substantially boiling the the range of 70° to 220° C., preferably in the range of 70° to 180° C. Preferably, the sulphur-containing feedstock consists essentially of a hydrocarbon mixture substantially boiling in the gasoline range.

A sulphur-containing feedstock which comprises a hydrocarbon mixture substantially boiling in the range of 140° to 220° C., preferably in the range of 160° to 220° C., can advantageously be coprocessed with the product from the reforming step in the hydrotreating step. Suitably the sulphur-containing feedstock comprising a hydrocarbon mixture substantially boiling the gasoline range can be derived from a (catalytic) cracking process. Suitably, hydrogen can be coprocessed with the product from the reforming step in the hydrotreating step.

Although not preferred it will be understood that part of the effluent from the reforming step can be subjected to a separation treatment.

It has been found that in the reforming step a catalyst can be applied which increases the aromatics content of the feedstock, such as stable (sulphur tolerant) metal-containing crystalline silicates showing a high selectivity towards aromatization. Suitably, in the reforming step a catalyst is applied which effects aromatization of at least 50% of olefins and/or naphthenes initially present in the sulphur-containing feedstock.

Suitably in the reforming step of catalyst is applied which comprises metal(M)-containing crystalline silicates having an X-ray diffraction pattern containing the four strongest lines at interplanar spacings (d), expressed in Å, of 11.1±0.2, 10.0±0.2, 3.48±0.07 and 3.72±0.06, and wherein m represents at least one of Al, Fe, Ga, W, Mo or Zn.

The metal(s) M can either be incorporated in the matrix of the zeolite or can be present in the pores of the catalyst. The metal(s) are preferably present in the pores of the catalyst.

The X-ray data quoted above can be obtained by diffraction of the Cu $K_{60}$ X-rays as well known in the art.

Preferably the catalyst to be used in the reforming step comprises metal-containing crystalline silicates such as ZSM-5, crystalline iron-containing crystalline (alumin)silicates or crystalline metallo silicates having the X-ray diffraction pattern is indicated hereinabove.

Suitably the catalyst applied in the reforming step comprises a crystalline aluminosilicate having a $SiO_2/Al_2O_3$ molar ratio of at least 50, preferably of at least 100, and the X-ray diffraction pattern as described hereinbefore.

Suitably a catalyst can be applied in the reforming step which comprises an iron-containing crystalline silicate. Preference is given to iron-containing crystalline silicates having a $SiO_2/Fe_2O_3$ molar ratio of 25 to 1000. In case the reforming step is carried out using an iron-containing crystalline aluminosilicate, the catalyst preferably has a $SiO_2/Fe_2O_3$ molar ratio of 25 to 1000 and a $SiO_2/Al_2O_3$ molar ratio of at most 2000.

Preferably, the reforming step is carried out using a catalyst as described hereinbefore which comprises at least one of the metals Ga, Mo, W or Zn, preferably Ga. Suitably, such a catalyst comprises from 0.01 to 10% by weight, more preferably from 0.1 to 5% by weight, of the above metal.

Further, the reforming step can suitably be carried out using a catalyst which comprises a metal-containing crystalline silicate having a Si/M molar ratio of 25 to 250, and wherein M is at least one of the metals Ga, Mo, W, or Zn, preferably Ga.

The metal-containing crystalline silicates may be prepared by methods known in the art, for example from aqueous solution containing the following compounds: one or more compounds of an alkali metal, one or more organic nitrogen compounds (RN) containing an organic cation or from which an organic cation is formed during the preparation of the silicate, one or more silicon compounds and one or more aluminium compounds. Preparation is effected by maintaining the mixture at an elevated temperature until the silicate has been formed and then separating the silicate crystals from the mother liquor and washing, drying and calcining the crystals.

Many synthetic routes exist to prepare these zeolitic catalysts. An extensive discussion can be found in "Hydrothermal Chemistry of Zeolites" by R. M. Barrer, Academic Press, New York, 1982.

The metal-containing silicates as prepared often contain alkali metal ions. By means of suitable exchange techniques these can be replaced by other cations, such as hydrogen ions or ammonium ions. The metal-containing crystalline silicates employed in the process according to the present invention preferably have an alkali metal content of less than 0.05% by weight. In the process according to the present invention the metal-containing crystalline silicates can be used as such or in combination with an inert binding material, such as kaolin or bentonite.

The metals can be incorporated by well-known techniques such as, for example, impregnation and ion-exchange. The metals are preferably introduced after crystallization of the silicate, for instance by post-impregnation.

Suitably, in the hydrotreating step use is made of an alumina-containing catalyst, for instance a silica-alumina-containing catalyst having both desulphurization and denitrogenation activity. Preferably, use is made in the hydrotreating step of a metal-containing alumina catalyst, whereby the metal is at least one of the group VIB and/or Group VIII metals, preferably at least one of the metals Ni, Co or Mo.

The catalysts which can suitably be applied in the hydrotreating step comprise commercially available catalysts and can be prepared by methods known in the art.

In the process according to the present invention for reforming step can suitably be carried out at a temperature of 350° to 600° C., a pressure of from 1 to 40 bar and a space velocity of from 0.5 to 10 g/g/h, and the hydrotreating step can suitably be carried out at a temperature of 230° to 370° C., a hydrogen partial pressure of 2 to 30 bar and a space velocity of 0.5 to 15 g/g/h. Preferably, the reforming step is carried out at a temperature of 400° to 550° C., a pressure of from 10 to 30 bar and a space velocity of from 0.5 to 5 g/g/h, and the hydrotreating step is carried out at a temperature of 250° to 350° C., a hydrogen partial pressure of from 3 to 15 bar and a space velocity of from 2.0 to 10 g/g/h.

The process according to the present invention can be carried out using a series of reactors or in a stacked-bed configuration. Use of a series of reactors containing the respective catalysts in preferred. It will be understood that the catalyst applied in the reforming step can be subjected to a regeneration treatment, preferably a semi-continuous regeneration.

The desired gasoline boiling range produce of reduced sulphur content and increased aromaticity may be recovered by any suitable means, usually by fractionation.

The ranges and limitations provided in the instant specification and claims are those which are believed to particularly point out and distinctly claim the instant invention. It is however, understood that other ranges and limitations that perform substantially the same function in substantially the same way to obtain substantially the same result are intended to be within the scope of the instant invention as defined by the instant specification and claims.

EXAMPLES

The invention will be described by the following example which is provided for illustrative purposes and are not to be construed as limiting the invention:

a) Composition of catalysts A and B.

Reforming catalyst A comprises a commercially available ZSM-5 type crystalline zeolite having a $SiO_2/Al_2O_3$ molar ratio of 240 and containing 130 ppm Na. Catalyst A was ion exchanged in its $H^+$ form with gallium as follows:

80 g of zeolite were refluxed for 1 hour in a 0.05 M solution of gallium nitrate. The sample was washed with distilled water, dried (120° C., 16 h) and then calcined at 540° C. for 2 h.

The resulting gallium-containing aluminosilicate contained 1% wt. of gallium.

Hydrotreating catalyst B comprises 84.1% Wt. of amorphous alumina and 2.7% wt. of nickel and 13.2% wt. of molybdenum.

b) Catalysts A and B were employed during 25 hours in an experiment carried out in accordance with the present invention. Catalyst B was firstly subjected to a presulphiding treatment. As feedstock a catalytically cracked gasoline was used having the following properties:

Boiling range: 85°-210° C.
Olefins in $C_5+$ (%wt): 28.6
Saturates in $C_{5+}$ (%wt): 24.9
Aromatics in $_{+5}C$ (ppmw): 2420
RON-O of $C_5$: 94

The operation conditions under which the experiment was carried out and the results obtained are given in Table 1 as shown hereinafter.

TABLE 1

| Catalyst | A | B |
|---|---|---|
| Conditions | | |
| Temperature (°C.) | 499 | 285 |
| Pressure (bar) | 20 | 16 |
| WHSV (g/g/h) | 2 | 7.5 |
| $H_2$ partial pressure | — | 7 |
| Products | | |
| Sulphur in $C_5+$ (ppmw) | 100 | |
| RON—O | 101 | |
| $C_5+$ yield (% wt) | 84.8 | |
| aromatics in $C_5+$ (% wt) | 71.0 | |

What is claimed is:

1. A process for upgrading a sulphur-containing feedstock comprising a hydrocarbon mixture substantially boiling in the gasoline range which process comprises reforming the hydrocarbon mixture, subsequently hydrotreating the resulting hydrocarbon mixture at a temperature between 230° C. and 370° C., a hydrogen partial pressure between 2 bar and 30 bar, and a space velocity of between 0.5 g/g/h and 15 g/g/h, and recovering therefrom a product substantially boiling in the gasoline range and having increased aromaticity and decreased sulphur content.

2. The process according to claim 1, wherein the hydrocarbon mixture is a fraction boiling in the range of 70° to 220° C.

3. The process according to claim 1, wherein the feedstock consists essentially of the hydrocarbon mixture substantially boiling in the gasoline range.

4. The process according to claim 1 wherein the feedstock comprises more than 50 ppmw of sulphur.

5. The process according to claim 1 additionally comprising feeding hydrogen to the hydrotreating step with the product from the reforming step.

6. The process according to claim 1 wherein a hydrocarbon mixture substantially comprising $C_{2-4}$ olefins and/or $C_7$ paraffins is coprocessed with the feedstock in the reforming step.

7. The process according to claim 1, wherein in the reforming step a catalyst is applied which comprises a metal(M)-containing crystalline silicate having an X-ray diffraction pattern containing the four strongest lines at interplanar spacings (d), expressed in Å, of 11.1±0.2, 10.0±0.2, 3.48±0.07 and 3.72±0.06, and wherein M is a metal selected from the group consisting of Al, Fe, Ga, W, Mo, Zn, and mixtures thereof.

8. The process according to claim 1, wherein the reforming step a catalyst is applied which comprises a crystalline aluminosilicate having a $SiO_2/Al_2O_3$ molar ratio of between b 50 and 2000.

9. The process according to claim 1, wherein in the reforming step a catalyst is applied which comprises an iron-containing crystalline (alumino)silicate having a $SiO_2/Fe_2O_3$ molar ratio of 25 to 1000, and in case alumina is present a $SiO_2/Al_2O_3$ molar ratio of at most 2000.

10. The process according to claim 1, wherein in the reforming step a catalyst is applied which comprises from 0.01 to 10% by weight of a metal selected from the group consisting of Ga, W, Mo, Zn, and mixtures thereof.

11. The process according to claim 1, wherein in the reforming step a catalyst is applied which comprises a metal-containing crystalline silicate having a Si/M molar ratio of 25 to 250, and wherein M is a metal selected from the group consisting of Ga, Mo, W, Zn, and mixtures thereof.

12. The process according to claim 11, wherein the metal is selected from the group consisting of Ni, Mo, Co, and mixtures thereof.

13. The process according to claim 1, wherein in the hydrotreating step an alumina-containing catalyst is applied.

14. The process according to claim 1, wherein the reforming step is carried out at a temperature of 350° C. to 600° C., a pressure of from 1 bar to 40 bar and a space velocity of from 0.5 g/g/h to 10 g/g/h.

15. The process according to claim 14, wherein the reforming step is carried out at a temperature of 400° to 550° C., a pressure of from 10 to 30 bar and a space velocity of from 0.5 to 5 g/g/h, and wherein the hydrotreating step is carried out at a temperature of 250° and 350° C., a hydrogen partial pressure of from 3 to 15 bar and a space velocity of from 2.0 to 10 g/g/h.

16. A composition comprising aromatic hydrocarbon-containing mixtures whenever prepared according to a process as described in claim 1.

17. A process for upgrading a sulphur-containing feedstock comprising a hydrocarbon mixture substantially boiling in the range of 140° C. to 220° C. which process comprises reforming the hydrocarbon mixture to produce a reformed product, subsequently hydrotreating the feedstock with the reformed product from the reforming step and recovering therefrom a product substantially boiling in the gasoline range and having increased aromaticity and decreased sulphur content, and wherein the hydrotreating takes place at a temperature between 230° C. and 370° C., a hydrogen partial pressure between 2 bar and 30 bar, and a space velocity of between 0.5 g/g/h and 15 g/g/h.

18. A process for upgrading a sulphur-containing feedstock comprising a hydrocarbon mixture substantially boiling in the gasoline range which process comprises reforming the hydrocarbon mixture, subsequently hydrotreating the resulting hydrocarbon mixture at a temperature between 230° and 370° C., a hydrogen partial pressure between 2 bar and 30 bar, and a space velocity of between 0.5 g/g/h and 15 g/g/h, and recovering therefrom a product substantially boiling in the gasoline range and having decreased sulphur content and wherein in the reforming step a catalyst is applied which increases the aromatics content of the feedstock.

19. The process according to claim 18, wherein a catalyst is applied which effects aromatization of at least 50% of olefins and/or naphthenes initially present in the feedstock.

20. A process for upgrading a sulphur-containing feedstock comprising a hydrocarbon mixture substantially boiling in the range of 70° to 220° and which has been derived from a catalytic cracking process and wherein the hydrocarbon mixture comprises more than 50 ppmw of sulphur which process comprises reforming the hydrocrabon mixture, wherein in the reforming step a catalyst is applied which comprises a metal-containing crystalline silicate having a Si/M molar ratio of 25 to 250, and wherein M is a metal selected from the group consisting of Ga, Mo, W, Zn, and mixtures thereof, subsequently hydrotreating the hydrocarbon mixture, wherein in the hydrotreating step a metal-containing catalyst is applied, wherein the metal is selected from the group consisting of Ni, Mo, Co, and mixtures thereof, wherein the reforming step is carried out at a temperature of 400° to 550° C., a pressure of from 10 to 30 bar and a space velocity of from 0.5 to 5 g/g/h, and wherein the hydrotreating step is carried out a temperature of 250° to 350° C., a hydrogen partial pressure of from 3 to 15 bar and a space velocity of from 2.0 to 10 g/g/h, and recovering therefrom a product substantially boiling in the gasoline range and having decreased sulphur content, and wherein aromatization is effected of at least 50% of olefins and/or naphthenes initially present in the feedstock.

* * * * *